US006942444B2

(12) United States Patent
Schoenbeck

(10) Patent No.: US 6,942,444 B2
(45) Date of Patent: Sep. 13, 2005

(54) SKID POSITIONING MACHINE

(75) Inventor: Elroy Schoenbeck, Red Bud, IL (US)

(73) Assignee: Red Bud Industries, Inc., Red Bud, IL (US)

( * ) Notice: Subject to any disclaimer, the term of this patent is extended or adjusted under 35 U.S.C. 154(b) by 151 days.

(21) Appl. No.: 10/313,379

(22) Filed: Dec. 6, 2002

(65) Prior Publication Data

US 2004/0131463 A1 Jul. 8, 2004

(51) Int. Cl.[7] ..... B65G 35/50
(52) U.S. Cl. ..... 414/788.1; 414/927
(58) Field of Search ..... 414/788.1, 927, 414/928, 929

(56) References Cited

U.S. PATENT DOCUMENTS 3,621,973 A * 11/1971 Carlson et al. ..... 198/456
3,887,060 A * 6/1975 Kamhues ..... 198/426
4,269,556 A * 5/1981 Martini ..... 414/790.8
6,435,352 B1 8/2002 Schoenbeck et al.

* cited by examiner

*Primary Examiner*—Richard Ridley
(74) *Attorney, Agent, or Firm*—Polster, Lieder, Woodruff & Lucchesi, L.C.

(57) ABSTRACT

A stacking machine has a conveyor which supports skids onto which panels sheared from side-by-side strips of metal sheet fall, there to accumulate in stacks. As the stacks form, empty skids are organized on a skid positioning machine located to the side of the stacking machine, and there the spacing between the skids corresponds to the spacing between the skids already on the conveyor. When stacks are completed, the conveyor moves the skids on which they are formed away, and the skid positioning machine deposits the properly spaced empty skids on the conveyor which moves them into the positions where they receive the panels. To this end, the conveyor of the stacking machine may have powered rollers, while the skid positioning machine has a carriage provided with transfer beams configured to fit between the rollers. The carriage moves from a retracted position to the side of the conveyor to an extended position along the rollers of the conveyor with the beams being generally above the rollers and the empty skids being on the beams. Thereupon the stacking machine elevates its conveyor, causing the transfer beams to sink into the spaces between the rollers and the rollers to lift the empty skids from the beams. The rollers then move the empty skids to a position in which they can receive panels.

14 Claims, 5 Drawing Sheets

SKID POSITIONING MACHINE

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates in general to equipment for handling sheet metal and, more particularly, to a machine for positioning empty skids in a stacking machine so that sheet metal panels can accumulate on such skids.

Metal sheet, particularly sheet steel, finds widespread use in manufactured products of many types, among which are housings for a variety of equipment including household appliances and cabinets of one sort or another. The metal sheet comes in large coils produced at rolling mills. In order to render the coiled metal sheet suitable for press work, the metal sheet must be withdrawn from the coil and cut into panels of sizes appropriate for the press work. This normally requires advancing the metal sheet into a shear and severing it transversely into panels, which fall from the shear one after the other. Often the metal sheet is much too wide for the panels required during the press work. In that event, the metal sheet is passed through a slitter which divides it into strips that then pass into the shear where each stroke of the shear blade produces multiple panels—as many as there are strips. The panels drop into a stacking machine where they accumulate in stacks, and when the stacks reach a predetermined number of panels, they are discharged, providing space for more stacks to form.

Each stack weighs far too much for a single individual to lift. To facilitate handling, skids, which are basically small pallets, are placed in the stacking machine where the panels accumulate, and indeed the stacks form on the skids. Each skid is slightly smaller, at least in width than the panels which accumulate on it, and this holds particularly true where the panels are cut from multiple strips that emerge from a slitter.

In this regard, the skids must not project laterally beyond the strips, for if they do they will interfere with dividers that lie along the sides of the strips to insure that the panels cut from the strips drop uniformly and accumulate with the margins of the stacked panels in registration. The stacking machine elevates the skids into the spaces between or along these dividers to receive the initial panels sheared from the strips, and if the skids are positioned improperly, they will interfere with the dividers and damage them. Thus, the operator of the stacking machine must manually position the skids to insure that they clear the dividers before the stacking machine elevates the skids. To be sure, a machine exists which pushes skids onto a stacking machine from one of its sides, and this machine can properly position a single pallet for receiving only a single panel with each stroke of the shear. Such a machine will also push multiple skids onto a stacking machine, each for receiving a different panel cut from a strip that emerges from a slitter. But the skids must be separated in the stacking machine before the machine elevates the skids, and this requires that the operator to reach into the machine and manually position the skids. The effort is taxing and time consuming.

BRIEF SUMMARY OF THE INVENTION

The present invention resides in a skid positioning machine on which empty skids are organized, with the proper spacing between them. The positioning machine sits adjacent to a stacking machine onto which multiple panels severed from side-by-side strips of metal sheet are delivered to accumulate in stacks on skids properly spaced in the positioning machine. Once a set of stacks is completed and the stacks and their skids removed, the skid positioning machine places the empty skids on the stacking machine properly spaced and otherwise properly located laterally. The invention also resides in the process of properly positioning empty skids in a stacking machine.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
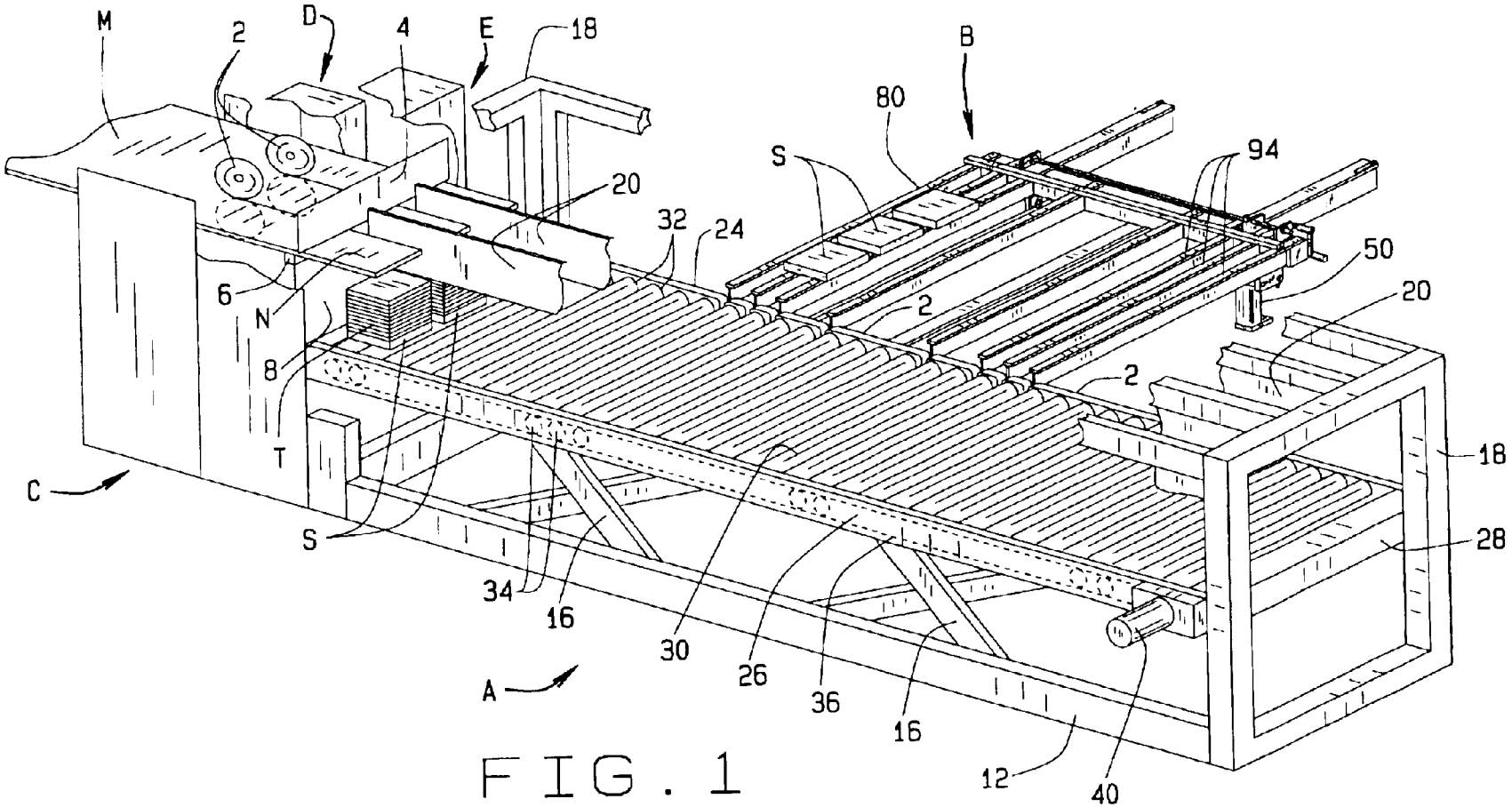
FIG. 1 is a perceptive view of a stacking machine which is supplied with empty skids by a skid positioning machine constructed in accordance with and embodying the present invention.
Figure 2:
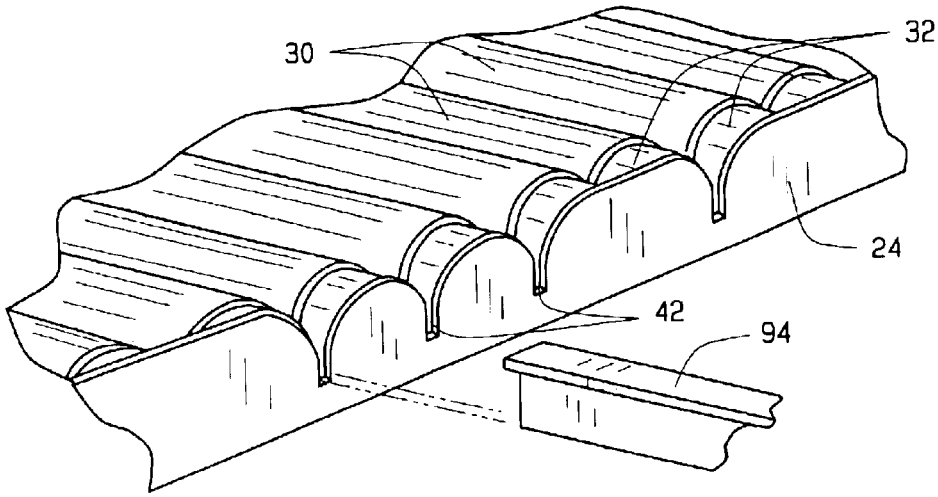
FIG. 2 is a is a fragmentary perspective view of the stacking machine taken along line 2—2 of FIG. 1.

Referring now to the drawings, a stacking machine A (FIG. 1) organizes metal panels P in separate, although side-by-side, stacks T, each of which is supported on a separate skid S which is in turn supported on the machine A. Actually, the panels P accumulate in the stacks T on the skids S, and when the side-by-side stacks T reach a prescribed number of panels P, the machine A moves the skids S and the stacks T which are on them away so that the machine A may receive empty skids S on which more panels P may accumulate in stacks T. The empty skids S are introduced into the machine A, properly separated and otherwise positioned laterally, for movement to a location where they can receive more panels P, this being achieved with a skid positioning machine B which is located along one side of the stacking machine A.

Actually, the stacking machine A is located downstream from a feeding machine C, a slitting machine D, and a shear E (FIG. 1). The feeding machine C grips the metal sheet M and advances it in precisely measured increments, with each increment being one of the dimensions of the panels P. As the sheet M advances, the slitting machine D slits it into side-by-side strips N. To this end, the slitting machine D has circular knives 2 arranged in pairs, with one knife 2 of each pair being above the sheet M and the other below the sheet M. The knives 2 of each pair do not align, but instead are slightly offset laterally. Moreover, the spacing between their peripheral surfaces is less than the thickness of the sheet M. As a consequence, the knives 2 of each pair fracture the sheet M, thus forming longitudinally directed slits, and these slits separate the individual strips N which are likewise formed. The strips N pass into the shear E which, once the feeding machine C completes an incremental advance, severs panels P from the strips N. To this end the shear E has a blade 4 which descends across cutting edge 6. As it does it severs panels P from the strips N, and those panels P fall along a shear face 8 below the cutting edge 6. Indeed, the panels P which are severed accumulate on skids S which are supported on the stacking machine A.

Actually, the skids S need not be positioned adjacent to the shear face 8 to receive the panels P. One type of stacking machine has an elevated conveyor which transports the individual panels P severed from the strips N to a downstream location at which they are deposited on skids S, and while the panels P drop along a face in such a machine, they do not fall along a shear face. The positioning machine B may serve to positioning skids S on such modified stacking machines as well.

Considering the stacking machine A first, it includes (FIG. 1) a base 12, which rests on a supporting surface such as a factory floor, and a movable frame or table 14 which is located above the base 12 where it aligns laterally with the metal sheet M and the strips N into which the sheet M is divided. Between the table 14 and the base 12 are jacks 16 which hydraulic or electric, but irrespective of that they control the elevation of the table 14. In addition, the stacking machine A has end frames 18 which rise above the table 14 and are fitted with dividers 20 that extend over the table 14 and align with the slits between the strips N of metal sheet M emerging from the slitting machine D. Indeed, the strips N, upon being projected beyond the cutting edge 6 of the shear E, pass along the dividers 20, or in other words the dividers 20 fit into the slits between adjacent strips N where they serve to divide the strips N and keep them from interfering with each other. The dividers 20 likewise separate the side-by-side stacks T of panels P. As such, the dividers 20 are quite thin, being typically about 0.045 inches thick, although they can be thicker. They run the full length of the table 14 and are maintained under tensions between the end frames 18.

The table 14 has side rails 24 and 26, the former being along the skid positioning machine B and the latter on the opposite side. In addition, the table 14 has cross members 28 which extend between the side rails 24 and 26 and are welded to them so that the table 14 has a good measure of rigidity. The rails 24 and 26 support a succession of conveying rollers 30 which extend between them and form an upwardly presented, yet interrupted, supporting or conveying surface that lies in a horizontal plane irrespective of the elevation of the table 14. The rollers 30 rotate in bearing 32 which are bolted to the rails 24 and 26. While the rollers 30 terminate at the bearings 32 along the rail 24, they extend through the bearings 32 along the rail 26 and beyond the rail 26 they are fitted with sprockets 34 over which a drive chain 36 passes. The drive chain 36 also passes over a sprocket on a reversible motor 40. When the motor 40 is energized, the rollers 30 revolve and move objects, such as the skids S that are supported on them, in either direction, depending on the direction of rotation for the motor 40. Thus, the rollers 30 form a conveyor. The side rail 24 between several of the bearings 32 that are attached to it has V-shaped notches 42 which open upwardly out of the rail 24 and provide lateral access to the spaces between the rollers 30 which are supported on those bearings 32.

In the operation of the stacking machine A, empty skids S are deposited on the rollers 30 somewhere between the ends of the table 14, in a transverse row, there being as many skids S in the row as there are strips N slit from the metal sheet M. Moreover, the skids S are located such that they align with the spaces delineated by the dividers 20, and as such each is offset slightly from the dividers 20. Once the skids S are correctly positioned on the rollers 30 of the table 14, the motor 40 is energized such that the rollers 30 move the skids S upstream to a receiving position adjacent to the shear face 8. Moreover, the jacks 16 elevate the table 14 to position the skids S slightly below the cutting edge 6 of the shear E, yet along the dividers 20. At this juncture the feeding machine C advances the metal sheet M until the strips N at its leading end project beyond the cutting edge 6 of the shear E a prescribed amount, whereupon the advance ceases and the blade 4 of the shear E descends. The blade 4 severs a panel P from each strip N, and those panels P drop along the dividers 20 onto the skids S that are supported on the rollers 30 of the table 14. The feeding machine A, thereupon advances the sheet M still farther an identical amount, and the blade 4 of the shear descends to sever more panels P of sizes equivalent to the previously severed panels P. Those subsequent panels P drop on to the previous panels P. The cycle repeats over and over again, thus creating stacks T of panels P on the skids S. As the stacks T grow the jacks 16 lower the table 14 so that the panels P fall essentially the same distance before coming to rest. The skids S, although slightly smaller than the panels P which accumulate on them, need to be positioned properly on the rollers 30 of the table 14, lest they come against and damage the dividers 20 as the jacks 16 elevate the table 14 and the skids S upon it. The skid positioning machine B serves that end.

The skid positioning machine B is located to the side of the stacking machine A—indeed, opposite the side rail 24 on the table 14 of the stacking machine A (FIG. 1). It allows an operator to position empty skids S on it with the proper spacing between those skids S, and after the empty skids S are so positioned, the machine B moves them over the rollers 30 on the table 14 of the stacking machine A where they are picked up by the rollers 30 as the jacks 16 elevate the table 14. As a consequence, the skids S rest on the rollers 30 properly spaced and positioned so that they will not interfere with the dividers 20.

Figure 4:
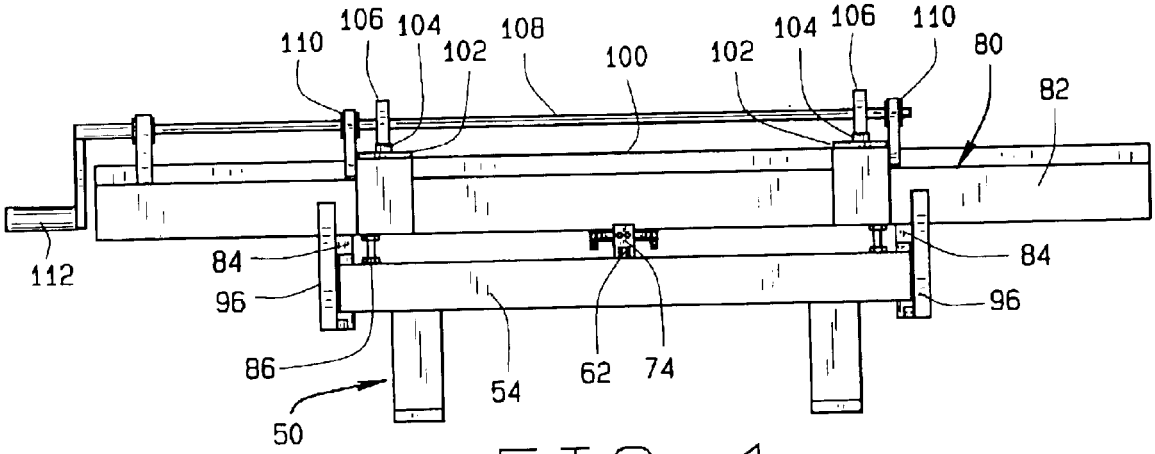
FIG. 4 is an end view of the skid positioning machine taken along line 4—4 of FIG. 3.
Figure 9:
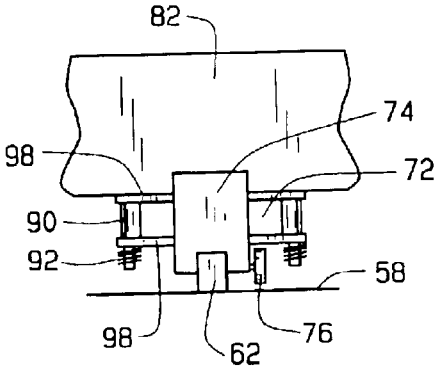
FIG. 9 is an enlarged end view of the friction coupling that couples the carriage and the guide assembly of the skid positioning machine.
Figure 3:
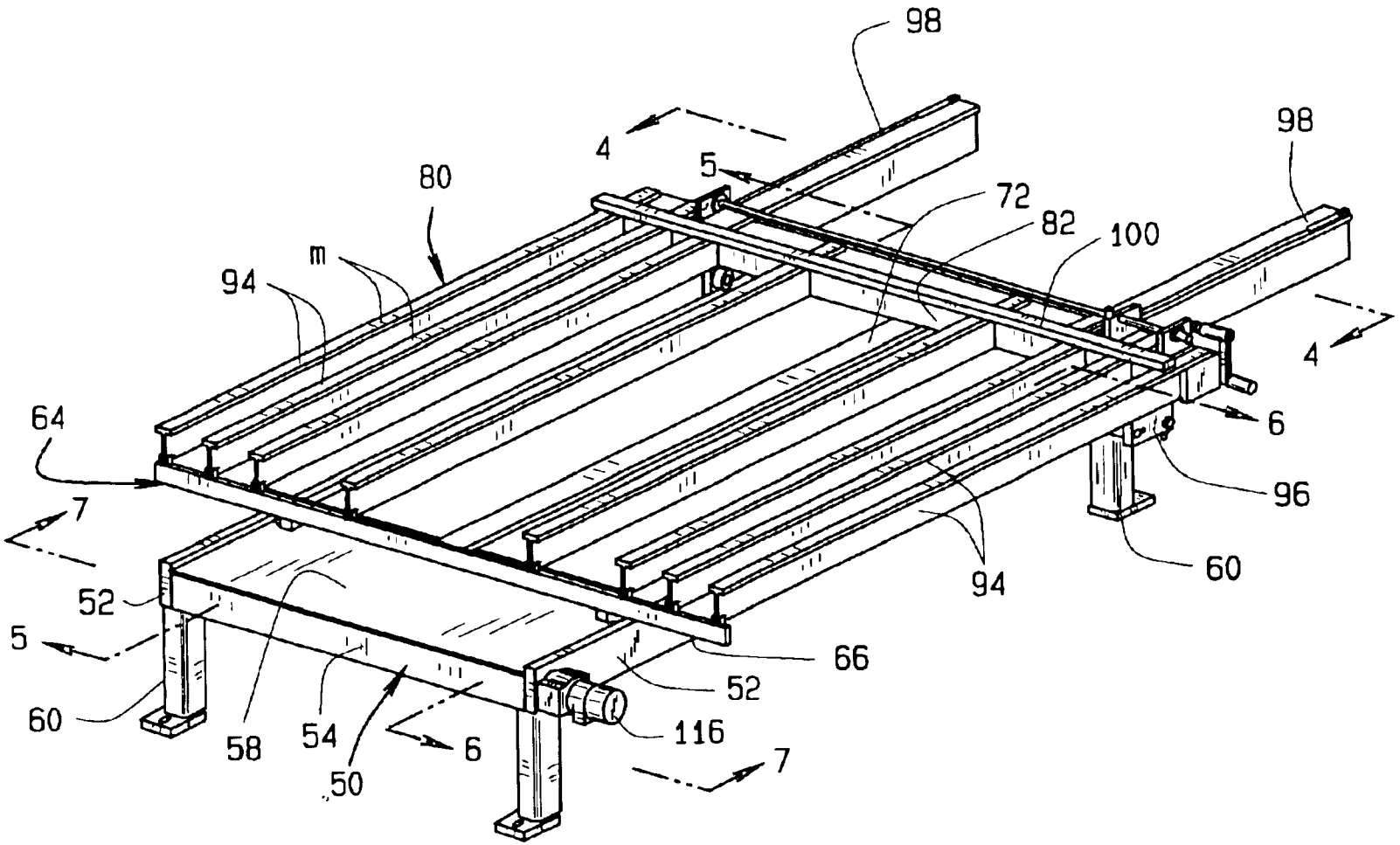
FIG. 3 is a perspective view of the skid positioning machine with its carriage retracted.

The skid positioning machine B includes (FIG. 3) a base 50 having side rails 52 which lie perpendicular to the side rails 24 on the frame 14 of the stacking machine A and cross rails 54 connecting the side rails 52. The upper surfaces of the side rails 52 lie slightly above the end rails 54 and serve as ways 56. Both the side rails 52 and the cross rails 54 support a cover plate 58 which is recessed slightly with respect to the ways 56 so that the side rails 52 project slightly above the plate 58. In addition, the base 50 has legs 60 which are joined to the side rails 52 at their ends and extend downwardly to the supporting surface so as to support the side rails 52, cross rails 54 and cover plate 58 in an elevated position adjacent to the side of the stacking machine A. The plate 58 midway between the side rails 52, and near the rearmost cross rail 54 is provided with a stop 62 (FIGS. 4 & 9) which projects above the plate 58.

Figure 7:
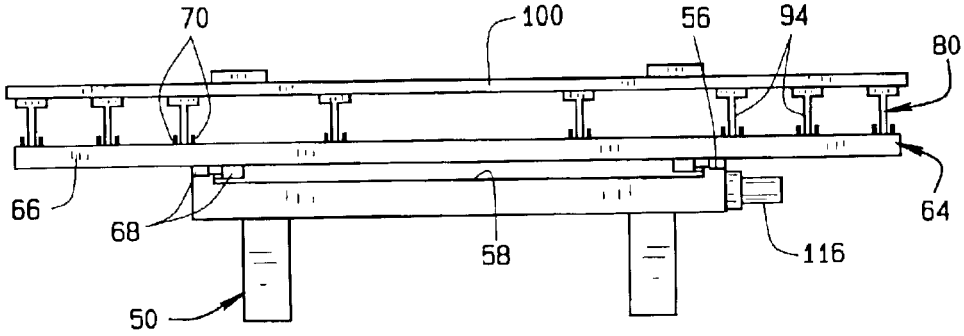
FIG. 7 is a front end view of the skid positioning machine taken along line 7—7 of FIG. 3.

In addition to the base 50, the skid positioning machine B has (FIGS. 3 & 7) a guide assembly 64 which has a limited capacity to move toward and away from the stacking machine A. The guide assembly 64 includes guide bar 66 which extends transversely over the plate 58 and beyond the side rails 52. The guide bar 66 has (FIG. 7) roller followers 68 which ride on the ways 56 that form the upper surface of the side rails 52 for the base 50 and more roller followers 68 that follow the inside surfaces of the side rails 52. Thus, the side rails 52 support the bar 66 and further prevent it from being displaced to one side or the other on the base 50. The guide bar 66 has guide tabs 70 arranged in pairs along its upper surface, with each tab 70 projecting upwardly from that surface. The tabs 70 of each pair are spaced apart about ½ in. When the table 14 of the stacking machine A is generally at the elevation of the top of the base 50 for the skid positioning machine B, the several pairs of tabs 70 on the cross bar 66 align with the V-shaped notches 42 in the side rail 24 of the table 14.

The guide assembly 64 also has (FIG. 3) a slide 72 which is attached to the guide bar 66 midway between its ends and extends rearwardly over the cover plate 58 of the table 50 toward the stop 62. The slide 72 at its opposite end is fitted with an end plate 74 (FIG. 9) which extends both upwardly and downwardly from it, and the lower portion aligns with the stop 62 on the cover plate 58. The end plate 74 carries a roller 76 which may roll over the cover plate 58 when the guide assembly 64 moves to and fro over the table 50.

Figure 5:
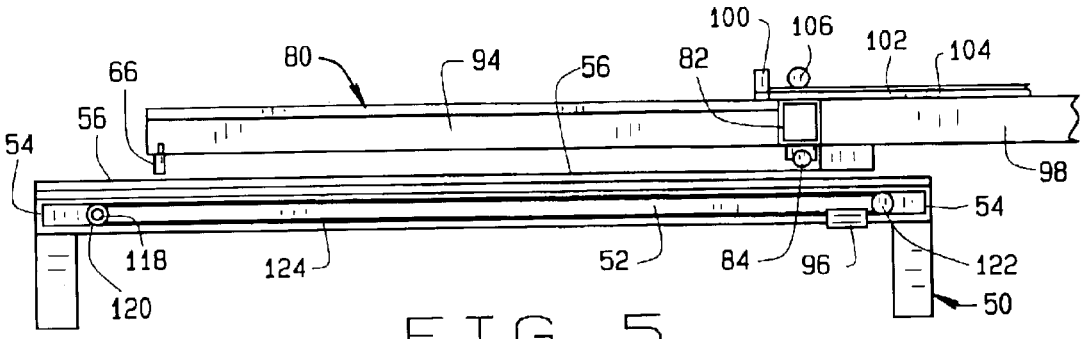
FIG. 5 is a sectional view taken along line 5—5 of FIG. 3.
Figure 6:
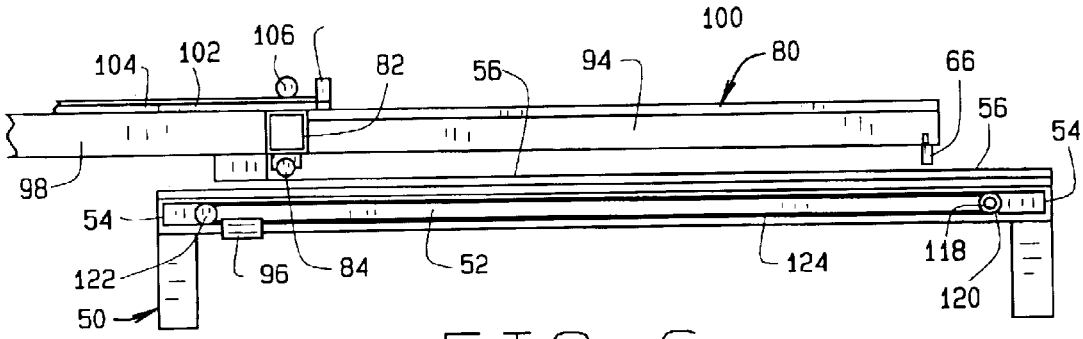
FIG. 6 is a sectional view taken along line 6—6 of FIG. 3.

In addition, the skid positioning machine B has (FIGS. 3, 4 & 7) a transfer carriage 80 which, like the guide assembly 64, moves toward and away from the table 14 of the stacking machine A. Indeed, the transfer carriage 80 can move from a retracted position, wherein it is located over the base 50, to extended positions, wherein it projects over the table 14 of the stacking machine A. The transfer carriage 80 includes a cross beam 82 which extends over the plate 58 and beyond the two side rails 52 at the sides of the base 50. The beam 82 has on its underside rollers 84 (FIGS. 5 & 6) which roll along the ways 56 on the side rails 52 of the base 50. It also has (FIG. 4) roller followers 86 which follow the inside surfaces of the side rails 52 and prevent the beam 82 from being displaced laterally at its center.

The cross beam 82 on its underside has a pair for friction plates 88 (FIG. 9) through which the slide 72 of the guide assembly 64 passes. The plates 88 are maintained in position along the underside of the beam 82 by threaded studs 90 which project downwardly from the beam 82 and pass through the plates 88. The studs 90 and are fitted with compression springs 92 which, in effect, clamp the slide 72 between the friction plates 88, yet not so tightly that the slide 72 cannot slip through the plates 88. The friction plates 88, studs 90, and springs 92 form a friction coupling that connects the guide assembly 64 with the carriage 80.

Extending forwardly from the cross beam 82 are transfer beams 94 (FIGS. 3 & 4) of T-shaped cross-sectional configuration. The transfer beams 94 at their trailing ends are welded to the cross beam 82 with their center legs projected downwardly and their horizontal portions presented upwardly and lying in a common horizontal plane. Those horizontal portions form a horizontal transfer surface. The center legs for the T-shaped transfer beams 94, at their forward ends, pass through the pairs of guide tabs 70 on the guide bar 66 of the guide assembly 64, so the guide tabs 70 not only prevent the forward ends of the beams 94 from being displaced laterally, but they also align the beams with the V-shaped notches 42 in the side rail 24 of the table 14 on the stacking machine A when the table 14 is lowered.

Figure 8:
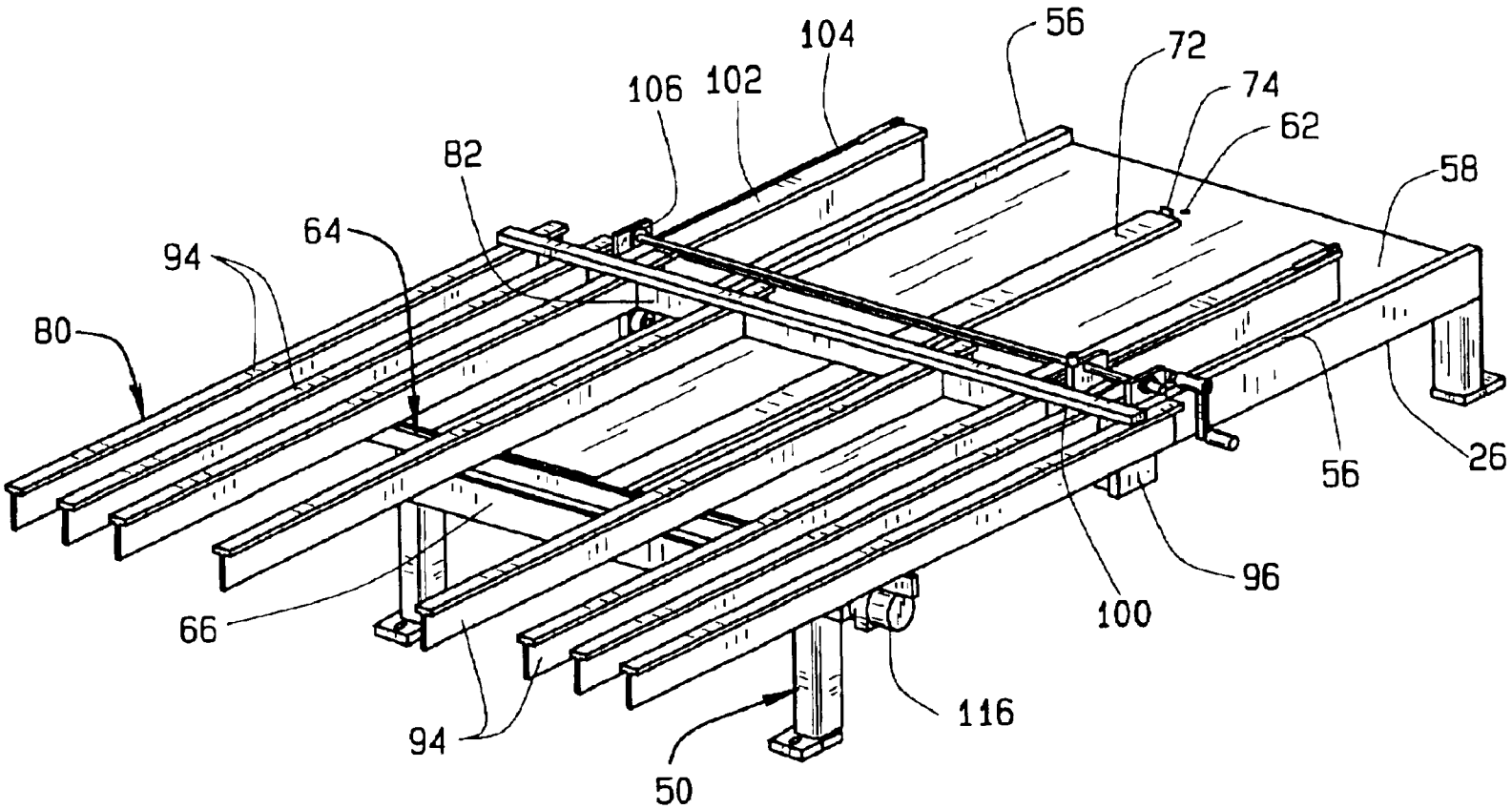
FIG. 8 is a perspective view of the skid positioning machine with its carriage extended.

Indeed, when the table 14 is at the proper elevation, the transfer carriage 80 may be displaced from a retracted position (FIG. 3) toward the stacking machine A and into an extended position (FIG. 8), and its transfer beams 94 will pass through the V-shaped notches 42 and into the spaces between the rollers 30 which border those notches 42. In this regard, the beams 94 are configured such that their vertical legs and horizontal portions will locate between the side faces of adjacent rollers 30, even to the extent that the horizontal portions and entirely below the uppermost portions of the rollers 30, that is below the horizontal conveying surface formed by the rollers 30.

The transfer beams 94 along their upwardly presented transfer surface are provided with (FIGS. 3 & 8) reference marks m that align transversely and may represent the centerline of the conveying surface formed by the rollers 30.

Along its sides, slightly to the rear of the cross beam 82, the carriage 80 is fitted (FIGS. 3 & 8) with drive brackets 96 which extend downwardly, terminating slightly below the side rails 52 of the table 50. Finally, the beam 82 supports end extensions 98 which project rearwadly from it.

The transfer carriage 80 is fitted with (FIGS. 3 & 8) a locator bar 100 that is attached to a pair of positioning members 102 which pass over the cross beam 82 and likewise over the rearwardly directed extensions 98 which support the members 102. Each positioning member 102 has a chain segment 104 attached to it to, in effect, form a rack on the member 102. The chain segments 104 are engaged by (FIG. 4) sprockets 106 that are mounted on a shaft 108 which extends over the cross beam 82 and over the members 102 for the locator bar 100. The shaft 108 rotates in bearings 110 mounted on the cross beam 82 and at one end is fitted with a hand crank 112. When the crank 112 is turned, it rotates the sprockets 106 which, being engaged with the rack-forming chain segments 104, displace the chain segments 104 and the positioning members 102 on which they are mounted. The locator bar 100, of course, moves with the members 102, and thus its position over the transfer beams 94 of the carriage 80 may be altered.

The transfer carriage 80 is moved to and fro over the base 50 by a reversible motor 116 which is mounted on one of the side rails 52 at the front corner of the base 50 toward which that side rail 52 extends. The motor 116 rotates a drive shaft 118 (FIGS. 5 & 6) which extends across the base 50 at the front cross member 54. The shaft 118 is fitted with drive sprockets 120. At the rear cross member 54 the base 50 is fitted with idler sprockets 122 along each of its side rails 52. Trained over the sprockets 120 and 122 along the side rails 52 are chains 124 which at their ends are attached to the drive brackets 96 that depend from the carriage 80. Thus, when the motor 116 is energized, the chains 124 move over the sprockets 120 and displace the carriage 80.

When the feeding machine C advances the metal sheet M a predetermined increment, the slitting machine D slits the sheet M into several strips N, depending on the number of opposed knives 2 above and below the sheet M. The advance further projects the strips N beyond the cutting edge 6 of the shear E a distance equal to the incremental advance (FIG. 1). The projecting portions of the strips N extend along the dividers 20. Once the metal sheet M and the strips N forming the end of it come to rest, the blade 4 of the shear E descends across the cutting edge 6 and shears as many panels P as there are strips N from the strips N. The panels P drop downwardly. A skid S lies below each projected strip N on the rollers 30 of the table, and these skids S receive the panels P in the sense that the panels P build up in stacks T on the skids S. The first panels P sheared from the strips N drop directly onto their respective skids S, while the next panels P drop onto the first panels P, and successive panels P accumulate, one on top of the other, until the stacks T so formed possess a requisite number of panels P.

In order to receive the panels P, the skids S need to be positioned on the rollers 30 of the stacking machine A with a reasonable amount of precision. Initially, they need not be positioned adjacent to the shear face 8 along which the panels P drop. Indeed, they may be positioned on the rollers 30 remote from the shear face 8 and then, by rotating the rollers 30 with the motor 40, moved to a position adjacent to the shear face 8. But the lateral positioning of the skids S needs to be performed with reasonable precision. The skid positioning machine B serves that end.

More specifically, as many empty skids S as there are strips N slit from the metal sheet M are placed on the transfer beams 94 of the carriage 80 that forms part of the skid positioning machine A (FIG. 1). Here the empty skids S are separated with the proper spacing and are further located in proper relation with respect to the reference marks m on the beams 94, which marks M may correspond to the center line of the conveying surface formed by the rollers 30 of the stacking machine A. In other words, the distance between each skid S and the reference marks m would be the same as the distance that skid S should be located from the centerline of the conveying surface formed by the rollers 30. With the skids S so positioned, the jacks 16 of the stacking machine A are activated to bring the movable frame 14 to an elevation in which the conveying surface formed by the rollers 30 is below the transfer surface formed by the beams 94 of the positioning machine B. Thereupon, the motor 116 of the positioning machine B is energized. It drives the transfer carriage 80 toward the side rail 24 on the moveable frame 14 of the stacking machine A. The guide assembly 64 moves with it, inasmuch as the friction plates 88 on the carriage 80 clamp the slide 72 of the guide assembly 64, and the slide 72 drives the guide bar 66 forwardly. The front ends of the transfer beams 94 remain between the tabs 70 on the guide bar 66 and thus align properly with the V-shaped notches 42 in the side rail 24 of the stacking machine A. After a short advance, the guide bar 66 comes against the side rail 24 of the stacking machine A, and the guide assembly 64 comes to rest. But the carriage 80 continues to advance, projecting its transfer beams 94 into the stacking machine A with the transfer surface formed by those beams 94 being above the conveying surface formed by the rollers 30. The guide assembly 64, even though it is at rest, does not prevent the further advance of the carriage 80, inasmuch as the friction plates 88 simply slip along the slide 72 as the carriage 80 continues to advance. The carriage 80 comes to rest when the reference marks m along its beams 94 reach and coincide with the centerline for the conveying surface formed by the rollers 30.

At this juncture the jacks 16 of the stacking machine A are activated to elevate the table 14 sufficiently to bring the conveying surface formed by its rollers 30 above the transfer surface on the transfer beams 94, but not so high as to bring the beams 94 into contact with the rollers 30 between which they fit. The skids S come to rest on the rollers 30.

With the skids S now supported by the rollers 30 instead of the beams 94, the motor 116 for the positioning machine B is again energized, but in the opposite direction. It retracts the carriage 80, allowing its beams 94 to withdraw from the spaces between the rollers 30 and the stacking machine A altogether.

The guide assembly 64 likewise retracts, inasmuch as the friction plates 88 of the carriage 80 grip its slide 72. However, the end plate 74 on the slide 72 in time comes against the stop 62 on the base 50, but the carriage 80 continues with its friction plates 88 slipping over the slide 72. In so doing, the retracting transfer beams 94 slide over the guide bar 66 of the guide assembly 64 between the tabs 70 which maintain them in the proper lateral positions.

In the meantime, the motor 40 of the stacking machine is energized such that the rollers 30 which it powers move the empty skids S toward the shear face 8 of the shear E. The skids S, having already been positioned laterally by the positioning machine B, approach the shear face 8 properly positioned laterally. The motor 40 is de-energized when the skids S come to the proper position with respect to the shear face 8. Next the jacks 16 are again activated to elevate the table 14 and the skids S on it. The skids S rise along the dividers 20, but do not interfere with or damage the dividers 20. Indeed, the table 14 brings the skids S to an elevation in which they are ready to receive panels P. It lowers the table 14 and the skids S as the panels P build up on the skids S.

While the panels P accumulate on the skids S, another set of empty skids S is organized on the transfer beams 94 of the positioning machine B so that they may be transferred to the rollers 30 of stacking machine A once the stacks T are complete and they and their skids S are moved out of the stacking machine A by the rollers 30.

The locator bar 100 may be used with the marks m to position the empty skids S, or it may be used in lieu of the marks m.

Some stacking machines, in lieu of a table provided with side-by-side rollers 30, have side-by-side chains which extend transversely with respect to the direction of advance for the metal sheet m and the strips N, that is to say parallel to the shear free 8. The skids S are supported on the chains adjacent to the shear face 8, and once the requisite number of panels P accumulate on them, the chains are activated and move the skid S and the stacks T of panels p on them away, with the direction of discharge being parallel to the shear face 8. But the chains like the rollers 30 have spaces between them and are carried by a table which is elevated and lowered on jacks.

The skid positioning machine B may be used to position skids S on a chain-type stacking machine as well. In such an arrangement, the skid positioning machine B is located at one end of the chain conveyor with its transfer beams 94 arranged and spaced to fit into the spaces between the chains of the conveyor. When the skids S are organized on the beams 94, care must be exercised to insure, not only that the spacing between them is correct, but also that they will locate properly with respect to the shear face when they are transferred to the conveyor chains. Otherwise, the skid positioning machine B operates with a chain-type stacking machine essentially the same as with the roller-type stacking machine A.

What is claimed is:

1. In combination with a stacking machine for organizing metal panels in stacks over skids and having a supporting surface on which the skids are supported as the panels are placed upon them to accumulate in stacks, a skid positioning machine for placing skids on the supporting surface of the stacking machine, said skid positioning machine comprising:

a carriage on which the skids are organized with the spacing between them corresponding to the spacing required for receiving the panels as the panels accumulate in stacks, the carriage being movable from a retracted position remote from the supporting surface of the stacking machine to an extended position along the supporting surface of the stacking machine so as to deposit the properly spaced skids on the supporting surface;

wherein the supporting surface of the stacking machine is interrupted such that it contains spaces, and the carriage has transfer beams which when the carriage is extended, will fit into the spaces in the supporting surface; and wherein the stacking machine includes rollers which form the supporting surface, and the transfer beams, when in their extended position, will fit between adjacent rollers.

2. The combination according to claim 1 wherein the skid positioning machine also includes a base on which the carriage moves, with the base and carriage being located adjacent to the supporting surface on the stacking machine; and wherein the positioning machine further comprises a motor coupled to the carriage for moving the carriage between its retracted and extended positions.

3. The combination according to claim 1 wherein the relative elevations between the transfer beams of the skid positioning machine and the supporting surface of the stacking machine can be changed so that the beams may be in a position in which they can transfer skids to and over the supporting surface and another position in which the skids are deposited on the supporting surface.

4. The combination according to claim 1 and further comprising a movable table on which the rollers are located and jacks for elevating and depressing the table between a transfer elevation in which the transfer beams are above the rollers so that skids on them may be moved over the rollers, and a loaded position in which the beams are below the upper surfaces of the rollers, whereby the beams will deposit skids on the rollers when the table moves from its transfer position to its loaded position.

5. The combination according to claim 4 wherein the stacking machine includes a motor that is coupled to the rollers for rotating them and transferring skids that are on them.

6. The combination comprising:

a stacking machine for supporting multiple skids side by side so that panels severed from adjacent strips of metal sheet may accumulate on the skids in stacks, said stacking machine comprising:

a base;

a table located above and supported on the base;

jacks for varying the elevation of the table over the base;

means located on the table for providing a conveying surface for the skids, with the conveying surface being interrupted by spaces; and a skid positioning machine for transferring skids to and depositing them on the conveying surface of the stacking machine such that the skids will be located to receive the panels, said skid positioning machine comprising:

a base located adjacent to the stacking machine;

a carriage mounted on the base such that it can move toward and away from the stacking machine, the carriage having transfer beams which provide a transfer surface for the skids and are capable of fitting into the spaces in the conveying surface of the stacking machine;

a motor coupled to the transfer carriage for moving the carriage between retracted and extended positions, the transfer beams when the carriage is in its retracted position being withdrawn from the stacking machine so that skids may be organized on them with the correct spacing between such skids, the transfer beams when the carriage is in its extended positions being located along the conveying surface of the stacking machine at the spaces in the conveying surface, whereby when the jacks of the stacking machine lower the table such that rollers of the table are below the transfer surface formed by the transfer beams, the motor may move the transfer beams and the skids on them over the conveying surface formed by the rollers, and when the jacks elevate the table high enough to bring the conveying surface above the transfer surface on the beams, the skids will be deposited on the rollers.

7. The combination according to claim 6 wherein the skid positioning machine also includes a guide assembly which guides the transfer beams and is movable on the base of the positioning machine with the transfer carriage.

8. The combination according to claim 7 wherein the carriage also includes a cross beam to which the transfer beams are fastened, with the transfer beams projecting forwardly from the cross beam toward the stacking machine; and wherein the guide assembly receives and guides the transfer beams between the cross beam and the stacking machine.

9. The combination according to claim 8 and further comprising a friction coupling between the guide assembly and the carriage so that the guide assembly will move with the carriage until restrained.

10. The combination according to claim 9 wherein the guide assembly includes a guide bar supported on the base below the transfer beams of the carriage and a slide attached to the guide bar and extending away from it toward the cross beam, and wherein the friction coupling engages the slide.

11. The combination according to claim 6 wherein the means for providing a conveying surface comprises side-by-side rollers; wherein the table of the stacking machine has side rails on which the rollers are supported and one of the rails is located adjacent to the skid positioning machine; and wherein the side rail along which the skid positioning machine is located has notches which extend below the conveying surface to receive the transfer beams when carriage is in its extended positions.

12. The combination according to claim 6 wherein the means for providing a conveying surface comprises side-by-side rollers wherein the stacking machine has a motor which is connected to the rollers to rotate the rollers; and wherein the skid positioning machine, when its carriage in its extended positions, locates skids over the conveying surface remote from the location on the conveying surface at which the skids receive the panels, and the rollers when energized by the motor of the stacking machine transports the skids from the location of the transfer beams to the location at which the panels may accumulate on them.

13. A process for locating skids on a conveying surface of a stacking machine into which multiple panels severed from side-by-side strips of metal sheet are discharged, so that the skids are located in positions suitable for receiving the panels and the panels accumulate on the skids to form stacks, said process comprising:

placing first skids on the conveying surface at locations suitable to receive the panels;

accumulating panels on the first skids to form stacks on the first skids;

while the panels are accumulating on the first skids, arranging second skids on a transfer surface of a carriage remote from the conveying surface with the proper positioning between adjacent second skids;

when the stacks are complete on the first skids, transporting the first skids and their stacks away from the location at which the panels are discharged onto the skids;

thereafter moving the transfer surface to the conveying surface with the second skids on the transfer surface and depositing the second skids on the conveying surface with the proper spacing between the skids and the skids aligned with the locations at which the panels discharge; and accumulating more panels on the second skids;

wherein the second skids are arranged on the transfer surface located to the side of the conveying surface; said process further comprising lowering the conveying surface;

moving the transfer surface over the conveying surface with the second skids properly spaced on the transfer surface;

elevating the conveying surface to lift the second skids from the transfer surface; and wherein the conveying surface is formed by rollers and the transfer surface is on beams which are capable of fitting between the rollers.

14. The process according to claim 13 and further comprising after the second skids are deposited on the conveying surface, transporting the second skids on the conveying surface to the location at which the panels are discharged toward the conveying surface.

* * * * *